US009873558B2

(12) United States Patent
Edwards

(10) Patent No.: US 9,873,558 B2
(45) Date of Patent: Jan. 23, 2018

(54) MULTI-DOSE CLEANING PRODUCT AND METHOD OF MANUFACTURE

(71) Applicant: MONOSOL, LLC, Merrillville (IN)

(72) Inventor: David Brian Edwards, Old Town Stevenage (GB)

(73) Assignee: MONOSOL, LLC, Merrillville, IN (US)

( * ) Notice: Subject to any disclaimer, the term of this patent is extended or adjusted under 35 U.S.C. 154(b) by 77 days.

(21) Appl. No.: 14/632,799

(22) Filed: Feb. 26, 2015

(65) Prior Publication Data

US 2016/0251148 A1 Sep. 1, 2016

(51) Int. Cl.

| | |
|---|---|
| ***C11D 17/04*** | (2006.01) |
| ***B65D 65/46*** | (2006.01) |
| ***B65D 85/808*** | (2006.01) |
| ***B65D 75/24*** | (2006.01) |
| ***B65D 75/38*** | (2006.01) |
| ***B65D 75/48*** | (2006.01) |
| ***B65D 81/32*** | (2006.01) |
| ***B65D 3/02*** | (2006.01) |
| ***B65B 3/02*** | (2006.01) |

(Continued)

(52) U.S. Cl.

CPC ..... *B65D 85/808* (2013.01); *B65B 3/022* (2013.01); *B65B 9/023* (2013.01); *B65B 9/042* (2013.01); *B65D 65/46* (2013.01); *B65D 75/24* (2013.01); *B65D 75/38* (2013.01); *B65D 75/48* (2013.01); *B65D 75/527* (2013.01); *B65D 81/3233* (2013.01); *C11D 17/042* (2013.01); *C11D 17/045* (2013.01); *C11D 17/046* (2013.01)

(58) Field of Classification Search

None

See application file for complete search history.

(56) References Cited

U.S. PATENT DOCUMENTS

| | | | |
|---|---|---|---|
| 4,776,455 | A | 10/1988 | Anderson et al. |
| 7,125,828 | B2 | 10/2006 | Catlin et al. |

(Continued)

FOREIGN PATENT DOCUMENTS

| | | | |
|---|---|---|---|
| DE | 102012214607 | A1 | 2/2014 |
| DE | 102012214608 | A1 | 2/2014 |

(Continued)

OTHER PUBLICATIONS

International Search Report and Written Opinion, corresponding to International Application No. PCT/US2016/019452, dated Apr. 28, 2016.

*Primary Examiner* — Lorna M Douyon

(74) *Attorney, Agent, or Firm* — Marshall, Gerstein & Borun LLP

(57) ABSTRACT

A web of multi-dose cleaning products and method of manufacturing the same is disclosed. The web includes a carrier sheet including first and second pluralities of depressions, a first plurality of pouches, and a second plurality of pouches. Each of the pouches is positioned in a respective depression in the carrier sheet. The first plurality of pouches contain a first cleaning composition, and the second plurality of pouches contain a second cleaning composition. A first end of the carrier sheet is folded over a second end of the carrier sheet so that each multi-dose cleaning product is defined by at least an overlapping pair of the first and second pouches and an overlapping pair of the first and second depressions.

19 Claims, 5 Drawing Sheets

(51) Int. Cl.

| | |
|---|---|
| ***B65B 9/02*** | (2006.01) |
| ***B65B 9/04*** | (2006.01) |
| ***B65D 75/52*** | (2006.01) |

(56) References Cited

U.S. PATENT DOCUMENTS

| | | | | |
|---|---|---|---|---|
| 7,439,215 | B2 | 10/2008 | Catlin et al. | |
| 7,521,411 | B2 | 4/2009 | Sharma et al. | |
| 8,156,713 | B2 | 4/2012 | Catlin et al. | |
| 8,551,929 | B2 | 10/2013 | Graham et al. | |
| 2004/0142131 | A1 | 7/2004 | Edwards et al. | |
| 2005/0109796 | A1 | 5/2005 | Bourque et al. | |
| 2009/0134054 | A1* | 5/2009 | Lee | B65B 9/04 206/531 |
| 2016/0200501 | A1* | 7/2016 | Lee | B65D 85/808 206/213.1 |

FOREIGN PATENT DOCUMENTS

| | | | |
|---|---|---|---|
| GB | 2374580 | A | 10/2002 |
| WO | WO-94/29104 | A1 | 12/1994 |
| WO | WO-2012/003042 | A1 | 1/2012 |
| WO | WO-2013/069037 | A1 | 5/2013 |
| WO | WO-2014/026855 | A1 | 2/2014 |
| WO | WO-2014/026856 | A1 | 2/2014 |

* cited by examiner

MULTI-DOSE CLEANING PRODUCT AND METHOD OF MANUFACTURE

TECHNICAL FIELD

The present disclosure generally relates to packaging and, more particularly, to packaging for multi-dose cleaning products.

BACKGROUND

Multi-dose cleaning products are commonly used in dish-washing and clothes washing applications. Multi-dose cleaning products typically include two or more different cleaning compositions in separate compartments (e.g., a detergent in one compartment and a rinse aid in another compartment). The amount of cleaning composition in each compartment is pre-measured so that the consumer does not have to measure an appropriate amount of each cleaning composition. Also, since each dose is packaged individually, the risk of skin contact with potentially irritating cleaning compositions is reduced. Additionally, multi-dose cleaning products allow a consumer to purchase a single product rather having to buy the cleaning compositions separately.

A multi-dose cleaning product typically comprises two or more water-soluble pouches, each filled with a respective cleaning composition (e.g., a powdered detergent, a liquid rinse aid, water softener, etc.). The exterior walls of the water-soluble pouches are typically very thin and thus susceptible to damage, particularly while the product moves through a supply chain. If the water-soluble pouches are exposed to water, water vapor, or any other potentially corrosive elements during their storage or transport, or at any other point prior to their use in a cleaning application, a risk exists that the water-soluble pouches will prematurely dissolve and release their contents. Furthermore, shifting and contact with other items during transport may inadvertently puncture the thin skin of the water-soluble pouches.

To protect the water-soluble pouches from damage, the pouches are typically placed inside a protective stand-up bag. These bags typically are made of a polyethylene (PE) film that is laminated with another material, such as polyethylene terephthalate (PET), to provide stiffness. While this kind of secondary packaging shields the water-soluble pouches from external elements, it has several downsides. If one of the water-soluble pouches breaks inside the bag due to, for example, mechanical shock, the damaged pouch may leak its contents and compromise the other water-soluble pouches in the bag. Also, it is typically necessary to include a re-sealing mechanism so that the consumer can re-seal the bag after removing the desired number of water-soluble pouches. Such a re-sealing mechanism increases the manufacturing costs of the bag. Additionally, the bags tend to be bulky and difficult to stack, and therefore oftentimes require a substantial amount of shelf space.

Another issue with water-soluble pouches is that their water-soluble film has the propensity to undergo "shrink-back" during thermoforming. This characteristic can prevent the full volume of the pouch from being utilized at the filing stage. To reduce the effects shrink-back, it is known to thermoform the water-soluble film together with a plastic carrier sheet, as described in U.S. Patent Publication No. 2004/0142131. An effect of thermoforming the water-soluble film and the plastic carrier sheet at the same time is that the water-soluble film acquires a temporary, or permanent, affinity for the plastic carrier sheet. As a result, the water-soluble film retains its shape and is less likely to experience shrink-back prior to filling. Accordingly, it is possible to utilize the full volume of the pouch at the filing stage. An additional benefit of the plastic carrier sheet is that it can serve as an external protective casing for the water-soluble pouches once the thermoforming process is complete. The plastic sheet thus eliminates the need to store the water-soluble pouches inside a protective external bag.

U.S. Patent Publication No. 2004/0142131 describes thermoforming a first water-soluble film to a first plastic carrier sheet, and subsequently, sealing a second water-soluble film and a second plastic carrier sheet over the top of the structure formed by the first water-soluble film and the first plastic sheet. The inclusion of the second plastic carrier sheet increases manufacturing costs and time. Also, the thermoforming process described in U.S. Patent Publication No. 2004/0142131 is only capable of producing unit dose cleaning products. This is because each external plastic compartment can only fit a single water-soluble pouch. Accordingly, the method described U.S. Patent Publication No. 2004/0142131 is not suitable for making multi-dose cleaning products.

SUMMARY

One aspect of the present disclosure provides a web of multi-dose cleaning products including a carrier sheet, a first plurality of pouches, and a second plurality of pouches. The carrier sheet has a first end, a second end, a first plurality of depressions, and a second plurality of depressions. The first plurality of pouches are disposed in the first plurality of depressions and contain a first cleaning composition. The second plurality of pouches are disposed in the second plurality of depressions and contain a second cleaning composition. The first end of the carrier sheet is folded over the second end of the carrier sheet so that each multi-dose cleaning product is defined by at least one pair of overlapping first and second pouches and at least one pair of overlapping first and second depressions.

Another aspect of the present disclosure provides a multi-dose cleaning product. The multi-dose cleaning product includes a folded carrier sheet defining a sealed interior volume, a first pouch, and a second pouch. The first pouch is within the sealed interior volume and contains a first cleaning composition. The second pouch is also within the sealed interior volume and contains a second cleaning composition.

Yet another aspect of the present disclosure includes a method of making a web of multi-dose cleaning products. The method includes: (a) positioning a first film face-to-face with a carrier sheet; (b) feeding the first film and the carrier sheet on to a mold of a forming machine with the carrier sheet being closest to the mold; (c) forming the first film and the carrier sheet over the mold at the same time to define a first plurality of internal holders in the first film, a second plurality of internal holders in the first film, a first plurality of external holders in the carrier sheet, and a second plurality of external holders in the carrier sheet; (d) filling each of the first plurality of internal holders with a first cleaning composition, and filling each of the second plurality of internal holders with a second cleaning composition; (e) positioning a second film to cover the first film; (d) sealing the second film around a rim of each of the first plurality of internal holders to define a first plurality of pouches, and sealing the second film around a rim of each of the second plurality of internal holders to define a second plurality of pouches; (e) folding the carrier sheet along a line dividing the first plurality of external holders and the second plurality of external holders such that each of the first plurality of pouches overlaps a corresponding one of the second plurality of pouches; and (f) sealing together overlapping portions of the carrier sheet.

DETAILED DESCRIPTION

The present disclosure generally concerns the manufacture and configuration of a web of multi-dose cleaning products. The web may be created by thermoforming a first water-soluble film to a water-resistant carrier sheet, and subsequently, sealing a second water-soluble film to the first water-soluble film to define a plurality of pouches. Thermoforming the first water-soluble film and the water-resistant carrier sheet at the same time results in a temporary, or permanent, affinity between the two materials which reduces, or eliminates, the effects of shrink-back of the first water-soluble film. Therefore, pouches formed by the first water-soluble film may not undergo shrink-back prior to being filled with a cleaning composition. In addition to reducing the effects of shrink-back, the water-resistant carrier sheet may provide an external casing that protects the pouches from mechanical damage and/or external elements such as water and oxygen. A separate protective bag or box is therefore not required to protect the pouches during their storage and transport. Furthermore, the water-resistant carrier sheet may be folded back on itself so that the pouches are arranged in overlapping pairs. Each pair of overlapping pouches, in combination with the abutting portions of the water-resistant carrier sheet, may define a multi-dose cleaning product. Overlapping ends of the water-resistant carrier sheet may be sealed together to provide a further barrier against external elements. The folded configuration of the water-resistant carrier sheet eliminates the need for a second water-resistant carrier sheet to cover the exposed sides of the pouches, and furthermore, provides a simple construction of the multi-dose cleaning products.

Another benefit of the folded configuration is that a web consisting of many multi-dose cleaning products can be shipped to a point of sale, where a single one of the multi-dose cleaning products can be detached from the web and sold individually to a consumer. Accordingly, the web of multi-dose cleaning products facilitates the sale of individual double-dose, triple-dose, etc. cleaning products to consumers, which may be useful in developing countries where consumers do have insufficient disposable income to purchase a web including a large number of multi-dose cleaning products. Also, because the individual multi-dose cleaning products are interconnected in the form of a web, they can be easily stacked and stored with other webs of multi-dose cleaning products, and other items, during storage and transport. Additional benefits and advantages of the web of multi-dose cleaning products will be apparent from the description set forth below.

Figure 1:
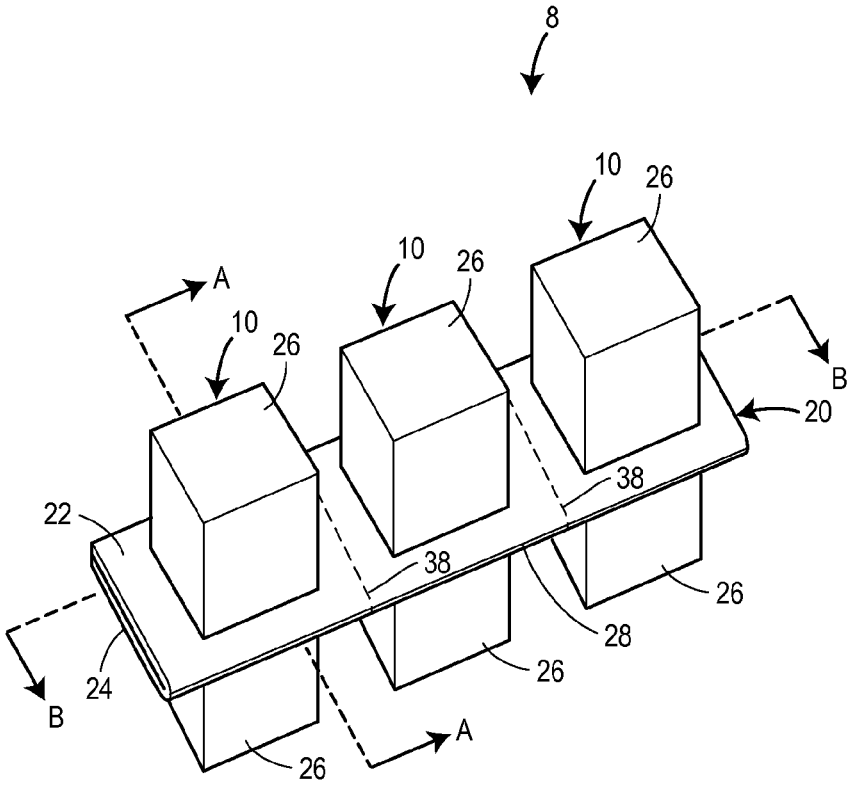
FIG. 1 is a perspective view of one embodiment of a web of multi-dose products constructed in accordance with principles of the present disclosure.
Figure 2:
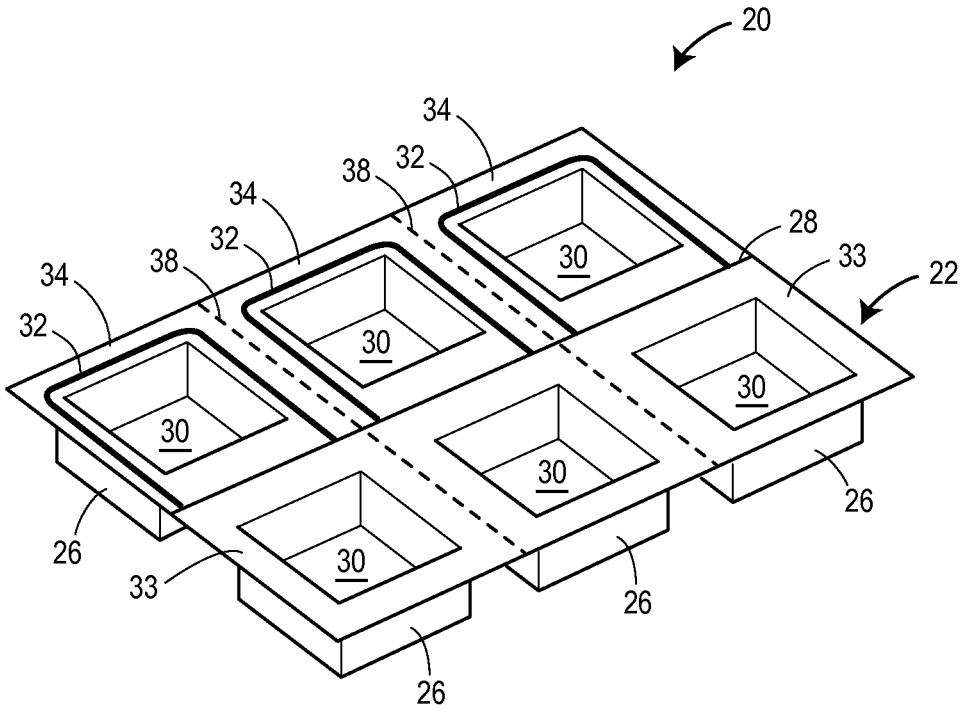
FIG. 2 is a perspective view of a carrier sheet of the web of FIG. 1 prior to folding and without pouches.

FIG. 1 illustrates one possible embodiment of a web 8 of multi-dose cleaning products 10. The web 8 includes a carrier sheet 20 having a first end 22 folded over a second end 24. The carrier sheet 20 also includes a plurality of depressions 26 created by thermoforming the carrier sheet 20 over a mold. After the carrier sheet 20 is thermoformed, and prior to folding the carrier sheet 20, the depressions 26 may be arrayed across the carrier sheet 20 in a pattern of parallel and aligned rows and columns, as illustrated in FIG. 2. While the carrier sheet 20 illustrated in FIG. 2 has two rows of depressions 26, other embodiments may be arranged differently, for example, with three or more rows of depressions 26.

The depressions 26 are essentially external holders that protect the pouches positioned inside them. The depressions 26 may have a squarish cross-section to facilitate release of the depressions 26 from a mold during thermoforming. The depth of each of the depressions 26 may be equal to, or substantially equal to, the height of the pouch to be positioned within the depression 26.

The carrier sheet 20 is folded along a folding line 28 that separates the depressions 26 into two groups of equal number. Some embodiments include an even number of rows of depressions 26, so that the depressions 26 can be divided into two equal groups with a single, straight folding line. After the first end 22 of the carrier sheet 20 is folded over the second end 24 of the carrier sheet 20, each of the depressions 26 on one side of the folding line 28 may overlap a corresponding one of the depressions 26 on the other side of the folding line 28. This arrangement results in pairs of overlapping depressions 26 as depicted in FIG. 1. Each pair of overlapping depressions 26 may define an interior cavity 30 for housing one or more pouches filled with a cleaning composition.

As depicted in FIG. 2, lines of sealing material 32 may be applied to an upper surface 33 of the carrier sheet 20, so that, after folding, the first end 22 of the carrier sheet 20 can be sealed to the second end 24 of the carrier sheet 20. The lines of sealing material 32 may inhibit, or prevent, external elements (e.g., water, water vapor, air, etc.) from entering the space between the first and second ends 22, 24 of the carrier sheet 20, and also from entering the interior cavities 30 formed by pairs of the overlapping depressions 26. The lines of sealing material 32 may be made of a low tack peelable adhesive (e.g., a UV-curable acrylic oligomer). As an alternative, or an addition, to the lines of sealing material 32, the first and second ends 22, 24 of the carrier sheet 20 may be heat welded together along lines corresponding to the lines of sealing material 32 illustrated in FIG. 2.

Furthermore, as depicted in FIG. 2, one of the lines of sealing material 32 may be offset from an outer edge of the second end 24 of the carrier sheet 20 such that a peel tab 34 is formed by the portion of the carrier sheet 20 disposed outwardly of the line of sealing material 32. The peel tab 34 may help a user grip the overlapping first and second ends 22, 24 of the carrier sheet 20 and pull them apart, thus breaking the lines of sealing material 32. Accordingly, the peel tab 34 may facilitate the unfolding of the carrier sheet 20 and provide access to the pouches inside the sealed interior cavities 30 of the carrier sheet 20.

The carrier sheet 20 is preferably made of a water-resistant material (e.g., a water-insoluble, hydrophobic material such as plastic) and is preferably at least semi-rigid. Suitable materials for the carrier sheet 20 include polyester and nylon/polyethylene laminates, preferably in their amorphous form. The carrier sheet 20 may be made of a recyclable material (e.g., polyethylene terephthalate (APET), polypropylene, etc.) so that the environmental impact of disposing the carrier sheet 20 is reduced. In some embodiments, the carrier sheet 20 may be made of a carbon neutral, or substantially carbon neutral, material such as for example, a biopolymer or another material derived from a biomass source (e.g., sugar beets, potatoes, wheat, etc.). One example of a suitable carbon neutral material for the carrier sheet 20 is BIOFRONT® manufactured and sold by Teijin Limited. BIOFRONT® is a type of biopolymer produced from a plant-based feedstock, and in some embodiments, may have a stereocomplex crystalline structure. The thickness of the carrier sheet 20 may be within a range between approximately (e.g., ±10%) 60-1000 μm, or 170-750 μm, or lesser or greater. In one embodiment, the carrier sheet 20 is a water-resistant film that is 170 um thick and made from amorphous polyester APET. The carrier sheet 20 may be thermoformed to create the depressions 26, as discussed below in more detail.

In some embodiments, the carrier sheet 20 may be made of a slowly dissolving water-soluble material such as those described in U.S. Provisional Patent Application No. 62/059,740, entitled "Degradable Materials and Packaging Made From Same," which is hereby incorporated by reference in its entirety. Examples of slowly dissolving water-soluble materials suitable for the carrier sheet 20 include hot water-soluble polyvinyl alcohol (PVOH), as well as, dissolved polyvinyl alcohol-starch blends manufactured and sold by Plantic Technologies.

Referring to FIG. 1, multiple weakened tear lines 38 may be formed in the carrier sheet 20. The weakened tear lines 38 may be formed by any suitable method including, for example, laser etching and/or scoring. The weakened tear lines 38 may facilitate individual detachment of the multi-dose cleaning products 10 from the web 8. As illustrated in FIG. 2, each weakened tear line 38 may each extend along a straight line from the first end 22 of the carrier sheet 20 to the second end 24 of the carrier sheet 20. After the carrier sheet 20 is folded, each multi-dose cleaning product 10 is separated from an adjacent multi-dose cleaning product 10 by one of the weakened tear lines 38. Also, each weakened tear line 38 may be bordered on opposite sides by lines of the sealing material 32, as shown in FIG. 2. As a result, removal of one of the multi-dose cleaning products 10 from the web 8 does not compromise the seal for the remaining multi-dose cleaning products 10 attached to the web 8. As noted above, the ability to remove one of the multi-dose cleaning products 10 from the web 8 may be advantageous in developing countries where consumers may only have the means to purchase one multi-dose cleaning product 10 at a time. Moreover, since the carrier sheet 20 can be made of a slowly dissolving water-soluble material, the carrier sheet 20 is less likely to become litter, which is may be beneficial in developing countries where garbage removal services may not exist or may be unreliable.

Figure 3:
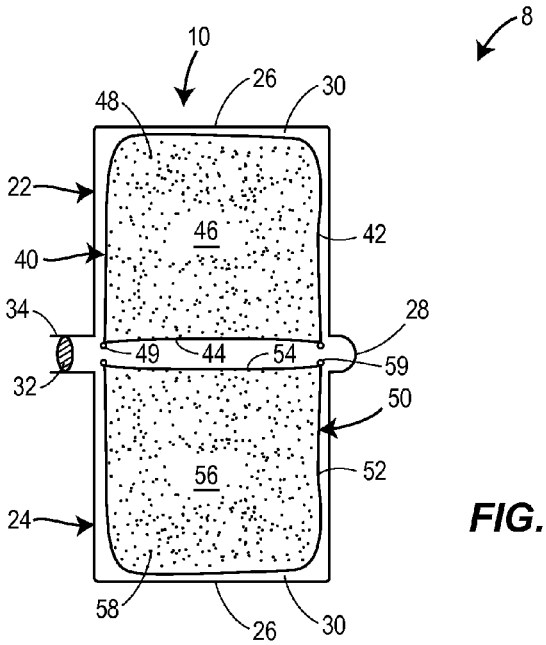
FIG. 3 is a cross-sectional view of FIG. 1 along plane A-A.
Figure 4:
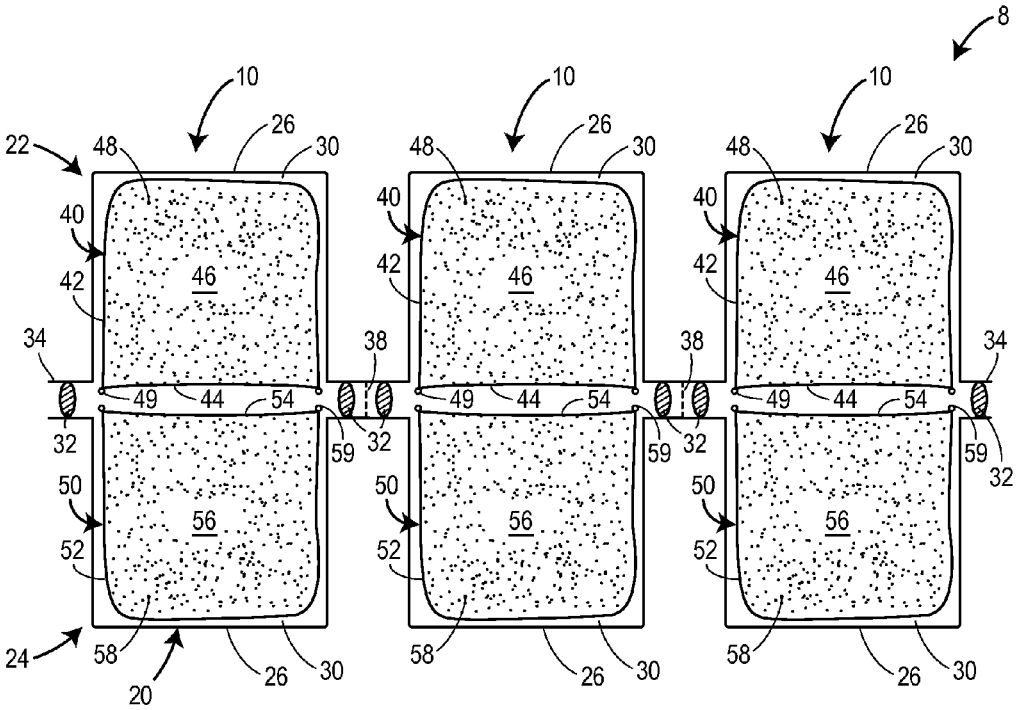
FIG. 4 is a cross-sectional view of FIG. 1 along plane B-B.

FIG. 4 illustrates that a first plurality of pouches 40 and a second plurality of pouches 50 are positioned in respective depressions 26 in the carrier sheet 20. The first plurality of pouches 40 are positioned in the depressions 26 at the first end 22 of the carrier sheet 20, and the second plurality of pouches 40 are positioned in the depressions 26 at the second end 22 of the carrier sheet 20. Prior to folding of the carrier sheet 20, the fold line 28 may separate the first plurality of pouches 40 from the second plurality of pouches 50, as depicted in FIG. 2. After folding, each of the first plurality of pouches 40 may overlap a corresponding one of the second plurality of pouches 50, as illustrated in FIGS. 3 and 4. Each pair of overlapping pouches 40, 50, in combination with their associated depressions 26, may define a multi-dose cleaning product 10. The web 8 illustrated in FIG. 1 includes three multi-dose cleaning products 10. In other embodiments, the web 8 may be constructed with a number of multi-dose cleaning products 10.

Each of the first plurality of pouches 40 may be formed by an internal holder 42 and a lid 44. The internal holder 42 may have a shape that corresponds to the shape of the depression 26 in which the internal holder 42 is housed. In one embodiment, the internal holder 42 has a square-shaped cross-section. As depicted in FIGS. 3 and 4, the internal holder 42 may possess an interior cavity 46 that is filled with a first cleaning composition 48. The lid 44 may cover an open end of the internal holder 44 and may be sealed around a rim 49 of the internal holder 42.

Similarly, each of the second plurality of pouches 50 may be formed by an internal holder 52 and a lid 54. The internal holder 52 may have a shape corresponding to that of the depression 26 in which the internal holder 52 is housed. In one embodiment, the internal holder 52 has a square-shaped cross-section. As illustrated in FIGS. 3 and 4, the internal holder 52 may have an interior cavity 56 that is filled with a second cleaning composition 58. The lid 54 may cover an open end of the internal holder 54 and may be sealed around a rim 59 of the internal holder 52.

As discussed below in more detail, a first film 60 may be used to make each of the internal holders 42, 52, and a second film 62 may be used to make each of the lids 44, 54. The first film 60 and/or the second film 62 is preferably a water-soluble material (e.g., hydrophilic material), and may be flexible, semi-rigid, or rigid. The first film 60 and/or the second film 62 may be cold-water soluble or hot-water soluble. A cold-water soluble material is one that is soluble in water at 20° C. or less, while a hot-water soluble material is one which is soluble in water at 60° or more. Material which is soluble between these temperatures can also be used. A pouch made of a cold-water soluble material may release its contents in 3 minutes or less when placed in un-agitated water at 20° C. or less. A pouch made of a hot-water soluble material may release its contents in 3 minutes or less when placed in un-agitated water at 60° or more.

The first film 60 and/or the second film 62 may be a mono-layer film or a multi-layer laminated film. Furthermore, the first and/or second films 60, 62 may be perfumed or colored to obtain aesthetically pleasing characteristics, or from any combination of these features. In some embodiments, the first and second films 60, 62 may be made of different grades, thicknesses, and/or materials.

Preferred materials for the first and second films 60, 62 include polyvinyl alcohol (PVOH), cellulose derivatives such as cellulose ethers, polyglycolides, polylactides, and/or polylactide-polyglycolide copolymers. In cold water applications, hydroxypropyl methyl cellulose (HPMC), as well as any of the foregoing materials, may be used for the first and second films 60, 62. The PVOH may be partially or fully hydrolyzed homopolymer of polyvinyl acetate (e.g., a copolymer of vinyl alcohol groups and vinyl acetate groups, or all vinyl alcohol groups). Additionally the PVOH may be a partially or fully hydrolyzed modified PVOH (for example 1-10 mole % anionic copolymer comprising groups such as monomethyl maleate sodium salt or 2-Acrylamido-2-methylpropane sulfonate sodium salt. For example, the PVOH may be alcoholised or hydrolysed in a range between 40-100%, or between 70-92%, or between 88-92%. The degree of hydrolysis is known to influence the temperature at which the PVOH starts to dissolve in water. 88% hydrolysis corresponds to a film soluble in cold (e.g., room temperature) water, whereas 92% hydrolysis corresponds to a film soluble in warm water. The material for the first and/or second films 60, 62 may also, in various embodiments, contain plasticizers and mold release agents, which may facilitate the manufacturing of the pouches 40, 50. The material may be produced by any process including, for example, extrusion (e.g., melt extrusion, etc.), blowing (e.g., melt blowing, etc.), and/or casting (e.g., solvent casting, solution casting, etc.). The material may be un-oriented, mono-axially oriented, or bi-axially oriented. If the layers in the film are oriented, they usually have the same orientation, although their planes of orientation may differ.

The thickness of the first and/or second films 60, 62 may be in a range between 20-500 μm, or between 30-300 μm, or between 35-200 μm, or between 40-160 μm, or between 40-150 μm, or between 40-120 μm. In one embodiment, the first and/or second films 60, 62 may be made of a PVOH film available as MonoSol M8630 and may have a thickness of approximately (e.g., ±10%) 75 μm.

The first and second cleaning compositions 48, 58 may be any composition which is intended to be released in an aqueous environment. The first and second cleaning compositions 48, 58 may be a dishwashing detergent, a laundry detergent, a water softener, a rinse aid, a surface cleaner, etc. The first and second cleaning compositions 48, 58 may have disinfectant, antibacterial, or antiseptic properties. The cleaning compositions 48, 58 may take any appropriate form including, but not limited to, a liquid, a gel, a paste, a solid, granules, or a powder. In one embodiment, the cleaning composition 48 and/or the cleaning computer 58 may take the form of a mull, consisting of a mixture of particles which are insoluble in a carrier (e.g., a mixture containing water-soluble particles and a glycerol or propylene glycol carrier incapable of dissolving the water-soluble particles).

In a preferred embodiment, the first cleaning composition 48 differs from the second cleaning composition 58. Accordingly, each multi-dose cleaning product may be formed with two or more pouches containing different cleaning compositions. A consumer seeking to purchase two or more different cleaning compositions can therefore purchase the multi-dose cleaning product instead of purchasing the cleaning compositions separately. In an alternative embodiment, the cleaning compositions 48, 58 may be made of the same material.

If the pouches 40, 50 are to be used in a laundry washing application, the first cleaning composition 48 may include, for example, a detergent, and the second cleaning composition 58 may include, for example, a bleach, stain remover, water-softener, enzyme, or fabric conditioner. Furthermore, the pouches 40, 50 may be adapted to release the first and second cleaning compositions 48, 58 at different times during a wash cycle. For example, a water-softener used for the first cleaning composition 48 could be released near the start of the wash cycle, and bleach or a fabric conditioner used for the second cleaning composition 58 could be released near the end of the wash cycle. This may be accomplished by fabricating the second pouch 50 from thicker films than the first pouch 40.

If the pouches 40, 50 are to be used in a dishwashing application, the first cleaning composition 48 may include, for example, a detergent and the second cleaning composition 58 may include, for example, a water-softener, salt, enzyme, rinse aid, bleach, or bleach activator. Furthermore, the pouches 40, 50 may be adapted to release the first and second cleaning compositions 48, 58 at different times during the wash cycle. For example, a salt or enzyme used for the first cleaning composition 48 could be released near the start of the wash cycle, and a rinse aid, bleach, or bleach activator used for the second cleaning composition 58 could be released near the end of a wash cycle. This may be accomplished by fabricating the second pouch 50 from thicker films than the first pouch 40.

Each of the pouches 40, 50 may be divided into multiple chambers (not illustrated) by internal walls so that each pouch can hold, and keep separate, multiple cleaning compositions. For example, one of more of the pouches 40, 50 may have a first chamber filled with a powered dishwashing detergent and a second chamber filled with a liquid rinse aid. The internal walls forming the different chambers may have different thicknesses so that the first and second chambers release their respective compositions at different times.

While the present embodiment of the web 8 includes three multi-dose cleaning products 10, each enclosing two pouches, alternative embodiments can be arranged differently. The web 8 may include any number of multi-dose cleaning products 10, including, for example, ten or more multi-dose cleaning products 10. Each multi-dose cleaning product 10 may include three, four, five, six, or more pouches, some or all containing a different cleaning composition. In one embodiment, each multi-dose cleaning product includes four pouches, formed by two pairs of overlapping pouches, and with each pouch containing a different cleaning composition.

In some embodiments, films of different thickness may be used to construct the pouches. As a result, the pouches may dissolve at different rates in the presence of water, and thus disperse their contents at different times during, for example, a dishwasher cleaning cycle.

Various aspects of the web 8 of multi-dose cleaning products 10 reduce the likelihood that a child will be able to access and/or want to ingest the cleaning compositions 48, 50. The weakened tear lines 38 may provide a first line of defense in that a small child may not have the gripping force to tear one of the multi-dose cleaning products 10 from the remainder of the web 10. Even if a child can perform this task, the line of sealing material 32 which adheres the first end 22 of the carrier sheet 20 to the second end 24 of the carrier sheet 20 provides another barrier that the child must break through in order to access the pouches 40, 50. In some embodiments, the force needed to break the weakened tear lines 38 and/or the force need to break through the sealing material 32 may be equal to or greater than approximately (e.g., ±10%) 250 N, or equal to or greater than approximately (e.g., ±10%) 300 N. Additionally, since the pouches 40, 50 are hidden from view inside the carrier sheet 20, colors and/or scents associated with the pouches 40, 50 are less likely to tempt the child to open the web 8 in order to gain access to the pouches 40, 50.

Secondary measures may also be implemented to ensure that, even if the child is able to open the web 8, the child is prevented and/or deterred from bursting the pouches 40, 50 and/or ingesting the cleaning compositions 48, 50. Such measures includes constructing the pouches 40, 50 to comply with some or all of the provisions set forth in the COMMISSION REGULATION (EU) No. 1297/2014 of 5 Dec. 2014 amended, for the purposes of its adaptation to technical and scientific progress, Regulation (EC) No. 1272/2008 of the European Parliament and of the Council on Classification. These provisions concern the safety of soluble packaging for detergents that are sold in dosages for single use by consumers. Among these provisions are requirements that the soluble packaging retain its contents for at least 30 seconds when the soluble packaging is placed in water at 20° C. Accordingly, in some embodiments, the first and second films 60, 62 used to construct the pouches 40, 50 may have the ability to retain the cleaning compositions 48, 50 within their respective pouches 40, 50 for at least 30 seconds when the pouches 40, 50 are placed in water at 20° C. This solubility may reduce the risk the pouches 40, 50 will dissolve if momentarily placed in the mouth of a child. In addition, the pouches 40, 50 may be constructed with a bursting strength that is equal to or greater than approximately (e.g., ±10%) 250 N, or equal to or greater than approximately (e.g., ±10%) 300 N. This may prevent a child from bursting the pouches 40, 50 with his or her hands and/or teeth.

As a tertiary measure, the cleaning compositions 48, 50 may include an orally-averse agent (e.g., a bittering agent) that deters a child from swallowing the cleaning compositions 48, 50 in the event that the child is able to open the pouches 40, 50. An example of such an orally-averse agent is denatonium, which is commonly sold under the trade name Bitrex. Additionally, or alternatively, the orally-averse agent may be incorporated into the carrier sheet 20 and/or the first and second films 60, 62 used to make the pouches 40, 50. The orally-averse agent may provide a last line of defense in the event that the foregoing childproof measures are not effective in preventing the child from gaining access to the cleaning compositions 40, 50.

Additional childproof measures may be incorporated into the web 8 of cleaning products 10 and the foregoing discussion is not intended to limit the number or type of childproof measures suitable for use in the web 8 of cleaning products 10.

Figure 5:
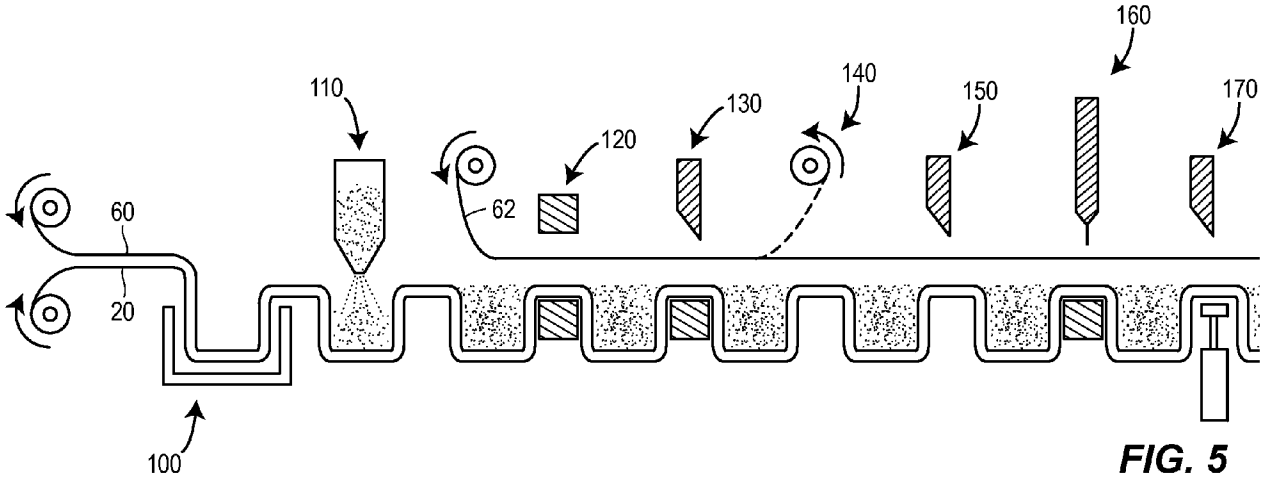
FIG. 5 is a schematic representation of one embodiment of a method of making a web of multi-dose products in accordance with principles of the present disclosure.
Figure 7:
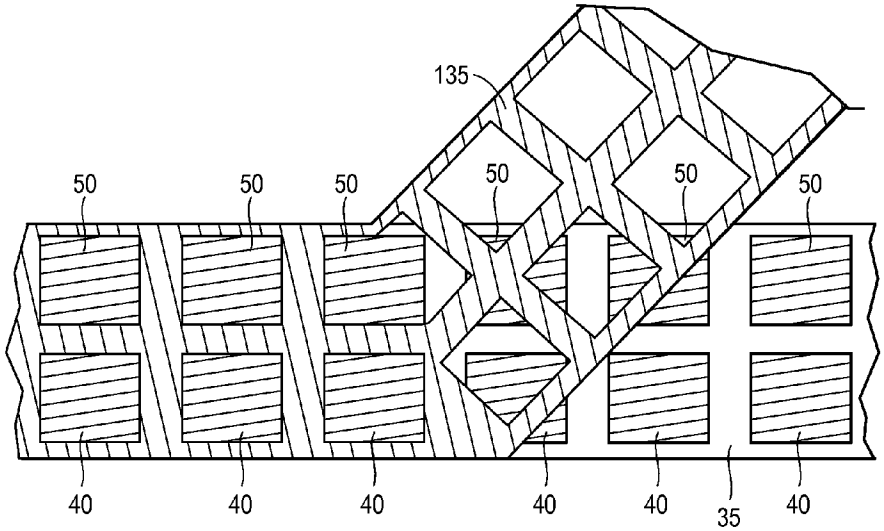
FIG. 7 is a schematic representation of cutting away excess portions of the first and second films to create individual pouches.
Figure 6:
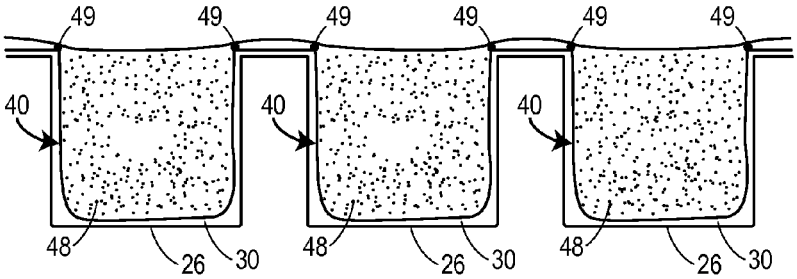
FIG. 6 is side view of the web of multi-dose products prior to cutting away excess portions of the first and second films to create individual pouches.

Referring to FIGS. 5-7, a method of manufacturing the web 8 of multi-dose cleaning products 10 will now be described. FIG. 5 illustrates the first film 60 being fed from a roll into a thermoformer 100 together with, and on top of, the carrier sheet 20. The carrier sheet 20 and the first film 60 may pass between rollers (not shown) which place them in intimate, face-to-face contact with substantially no air trapped between them before passing to the thermoformer 100. In the thermoforming process, both the carrier sheet 20 and the first film 60 are formed simultaneously. That is, the thermoformer 100 creates the depressions 26 (i.e., the external holders) in the carrier sheet 20 and the internal holders 42, 52 in the first film 60, at the same time.

The thermoforming process entails vacuum forming or pressure forming, or some combination of the two. Vacuum forming may involve heating the carrier sheet 20 and the first film, pressing a mold against the first film 60, and vacuuming out air between the first film 60 and the mold so that the carrier sheet 20 and the first film 60 assume the shape of the mold. Pressure forming may involve heating the carrier sheet 20 and the first film 60, pressing the carrier sheet 20 against a mold by vacuuming out air between the carrier sheet 20 and the mold, and applying positive air pressure above the carrier sheet 20 and the first film 60 so that the first film 60 assumes the shape of the mold.

Thermoforming creates a temporary, or permanent, affinity is created between the carrier sheet 20 and the first film 60 such that the first film 60 clings to the carrier sheet 20. It is important to note that it is possible to peel the first film 60 away from the carrier sheet 20 at this stage, if so desired. If left for a period of time, the first film 60 may begin to shrink-back. However, the time required for shrink-back to begin is considerably extended, as compared to the rate of shrink-back of a film which has not been thermoformed. The affinity between the carrier sheet 20 and the first film 60 is useful when the internal holders 42, 52 are filled by a filing machine 110 with the first and second cleaning compositions 48, 58, respectively. Since little or no shrink-back of the first film 60 occurs prior to filling, the entire volume of each of the cavities 46, 56 of the internal holders 42, 52 may be filled with the cleaning compositions 48, 58.

Once the internal holders 42, 52 have been filled with their respective cleaning compositions 48, 58, the second film 62 may be positioned to cover the first film 60, and then sealed, at the sealing station 120, around the rim 49 of each of the internal holders 42 and the rim 59 of each of the internal holders 52, at the sealing station 120. Any suitable method may be used for sealing the second film 62 to the first film 60, including, for example, adhesives and welding by heat, ultrasound, laser, vibration, spin, radio frequency, solvent welding, or any combination thereof. After sealing, the second film 62 encloses the contents of each of the internal holders 42, 52, as illustrated in FIG. 6. In one embodiment, sealing together the first and second films 60, 62 involves thermoforming the films 60, 62 at the same time.

Next, to separate the individual pouches 40, 50 from each other, the first and second films 60, 62 are cut at the cutting station 130. This may be achieved by die-cutting through the first and second films 60, 62 around the rims 49, 59 of each of the pouches 40, 50, but not through the underlying carrier sheet 20. Subsequently, the waste in-between material may be removed at a rewind station 140. FIG. 7 illustrates a plan view of this operation. After cutting the first and second films 60, 62 at the cutting station 130, the waste material 135 is removed upwards to the rewind station 140, leaving behind the separated pouches 40, 50 held in their respective depressions 26 in the carrier sheet 20. The upper surface 33 of the carrier sheet 30 is exposed by this process. The cutting and removal process may be similar to that used in the flat bed die-cutting of self-adhesive labels (in which only the self-adhesive face material is cut, leaving the self-adhesive label adhering to the uncut siliconed release material).

Once the pouches 40, 50 have been cut and the waste material 135 removed, the weakened tear lines 38 may be formed in the carrier sheet at station 150. The weakened tear lines 38 may be formed by any suitable method including, for example, laser etching and/or scoring. The weakened tear lines 38 may divide the carrier 20 into pairs of depressions 26 as illustrated in FIG. 2. The depressions 26 of each pair may be located on opposite sides of the folding line 28 (which, at this point in the method, has not been created). In alternative embodiments, the weakened tear line 38 may divide the carrier sheet 20 into groups of four of more depressions 26, depending on the number of pouches to be included in each multi-dose cleaning product 10.

Following the creation of the weakened tear lines 38, the lines of sealing material 32 (seen in FIG. 2) may be applied to the exposed upper surface 33 of the carrier sheet 20 at the sealing station 160. The lines of sealing material 32 ensure that, after the carrier sheet 20 is folded, the first end 22 of the carrier sheet 20 adheres to the second end 24 of the carrier sheet 20. The lines of sealing material 32 may be made of any suitable adhesive material including, for example, epoxies, polyurethanes, acrylics, and/or silicones. As illustrated in FIG. 2, one of the lines of sealing material 32 may follow the perimeter of the outer edge of the second end 24 of the carrier sheet 20. Alternatively, or additionally, a line of sealing material 32 may follow the perimeter of the edge of the second end 24 of the carrier sheet 20. The lines of sealing material 32 may be offset from the outer edge of the carrier sheet 20 so that the peel tab 24 is formed. Lines of sealing material 32 may also be provided on opposite sides of each of weakened tear lines 38 as shown in FIG. 2. Therefore, removal of one of the multi-dose cleaning products 10 form the web 8 will not impact the seal of an adjacent multi-dose cleaning product 10.

Any suitable material may be used for the lines of sealing material 32 including a self-curing adhesive or a heat-activated welding material. As an alternative, or as an addition, to lines of sealing material 32, the first and second ends 22, 24 of the carrier sheet 20 may be sealed together by melting the first and second ends 22, 24 of the carrier sheet 20 after the carrier sheet 20 has been folded. Such a melting procedure may involve applying heat to the carrier sheet 20 through, for example, electricity, lasers, vibration, spin, radio frequency, or some combination thereof.

Figure 8:
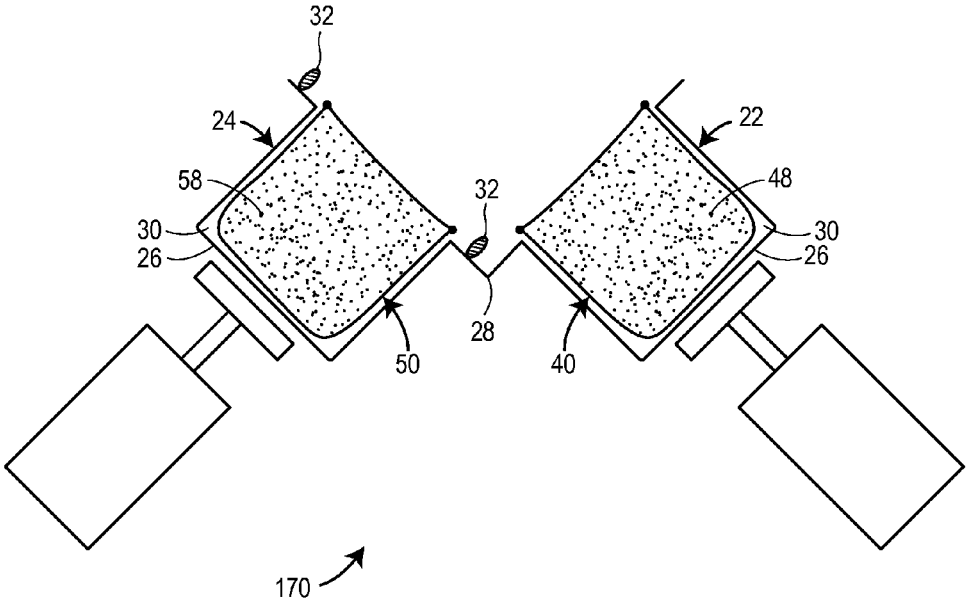
FIG. 8 is side view of folding the web.

After the sealing station 160, the carrier sheet 20 and pouches 40, 50 are fed to a cutting and folding station 170. Here, the carrier sheet 20 may be cut perpendicular to its longitudinal axis so that the resulting cut portion of the carrier sheet 20 contains a desired number of pouches 40, 50. Then, the carrier sheet 20 may be folded along the folding line 28 so that each of the pouches 40 overlaps a corresponding one of the pouches 50. The folding procedure may be accomplished by holding down the carrier sheet 20 along the folding line 28 and pushing up on the first and second ends 22, 24 of the carrier sheet 20 from underneath, as illustrated in FIG. 8. The first and second ends 22, 24 of the carrier sheet 20 may adhere to each other after folding due to the presence lines of sealing material 32. After folding, each one of the depressions 26 on one side of the folding line 28 may overlap a corresponding one of the depressions 26 on the other side of the folding line 28. Also, each one of the pouches 40 may overlap a corresponding one of the pouches 50. Each pair of overlapping pouches 40, 50, in combination with their associated overlapping depressions 26 in the carrier sheet 20, may define a multi-dose cleaning product 10. By folding the carrier sheet 20 in this manner, there is no need to position a cover sheet over the top of the carrier sheet 20 to enclose each of the pouches 40, 50 in their respective depressions 26. Also, folding of the carrier sheet 20 provides a relatively simple and efficient method of creating the multi-dose cleaning products 10.

While the present embodiment includes two pouches per multi-dose cleaning product 10, other embodiments can be arranged differently, for example with three, four, five, six, or more pouches per multi-dose cleaning product 10. Also, depending on where the carrier sheet 20 is cut, the final web 8 may have any number of multi-dose cleaning products 10, including three multi-dose cleaning products as illustrated in FIG. 1.

From the foregoing, it can be seen that the present disclosure advantageously provides an improved configuration and method of forming a web of multi-dose cleaning products. The elimination of a cover sheet for protecting the pouches held in the carrier sheet reduces manufacturing costs and time. Also, folding the carrier sheet provides a relatively simply and efficient method for pairing the pouches to create the multi-does cleaning products. Furthermore, the effects of shrink-back are reduce or eliminated by thermoforming together the film for the pouches and the carrier sheet, which enables filling the entire volume of the pouches with a cleaning composition.

While the present disclosure has been described with respect to certain embodiments, it will be understood that variations may be made thereto that are still within the scope of the appended claims.

What is claimed is:

1. A web of multi-dose cleaning products comprising:

a carrier sheet having a first end, a second end, a first plurality of depressions, and a second plurality of depressions;

a first plurality of pouches disposed in the first plurality of depressions and containing a first cleaning composition;

a second plurality of pouches disposed in the second plurality of depressions and containing a second cleaning composition; and the first end of the carrier sheet being folded over the second end of the carrier sheet so that each multi-dose cleaning product is defined by at least one pair of overlapping first and second pouches and at least one pair of overlapping first and second depressions, the first and second ends of the carrier sheet being sealed together to inhibit the ingress of foreign material.

2. The web of claim 1, the first and second pluralities of pouches being made of a water-soluble material.

3. The web of claim 2, the carrier sheet being made of a water-resistant material.

4. The web of claim 3, comprising:

each of the first plurality of pouches having a first holder filled with the first cleaning composition and a first lid covering an open end of the first holder; and each of the second plurality of pouches having a second holder filled with the second cleaning composition and a second lid covering an open end of the second holder.

5. The web of claim 3, the first and second holders being thermoformed to the carrier sheet.

6. The web of claim 1, at least one of the multi-dose cleaning products being defined by at least two pairs of overlapping first and second pouches and two pairs of overlapping first and second depressions.

7. The web of claim 6, comprising a plurality of weakened tear lines formed in the carrier sheet such that multi-dose cleaning products are separately detachable from the web.

8. The web of claim 1, wherein:

each of the first plurality of pouches includes a first lid made of a water-soluble material;

each of the second plurality of pouches includes a second lid made of a water-soluble material; and each overlapping pair of first and second pouches is arranged such that the first lid of the first pouch faces and is immediately adjacent to the second lid of the second pouch.

9. The web of claim 1, a first face of the carrier sheet being sealed directly to a second face of the carrier sheet to inhibit the ingress of foreign material.

10. The web of claim 1, the first cleaning composition being at least one of a dishwashing detergent, a laundry detergent, a water softener, or a rinse aid.

11. A multi-dose cleaning product comprising:

a folded carrier sheet having a first end with a first depression and a second end with a second depression, the first end overlapping and being sealed to the second end to define a sealed interior volume;

a first pouch within the sealed interior volume and containing a first cleaning composition; and a second pouch within the sealed interior volume and containing a second cleaning composition.

12. The multi-dose cleaning product of claim 11, the first pouch being formed by a first water-soluble holder filled with the first cleaning composition and a first water-soluble lid covering an open end of the first water-soluble holder.

13. The multi-dose cleaning product of claim 12, the second pouch being formed by a second water-soluble holder filled with a second cleaning composition and a second water-soluble lid covering an open end of the second water-soluble holder.

14. The multi-dose cleaning product of claim 13, the folded carrier sheet being made of a water-resistant material.

15. The multi-dose cleaning product of claim 14, the first and second water-soluble holders being thermoformed to the folded carrier sheet.

16. The multi-dose cleaning product of claim 11, wherein:

the first pouch includes a first lid made of a water-soluble material;

the second pouch includes a second lid made of a water-soluble material; and the first lid of the first pouch faces and is immediately adjacent to the second lid of the second pouch.

17. The multi-dose cleaning product of claim 11, a first face of the carrier sheet being sealed directly to a second face of the carrier sheet to inhibit the ingress of foreign material.

18. The multi-dose cleaning product of claim 11, the first pouch being disposed in the first depression in the first end of the carrier sheet and the second pouch being disposed in the second depression in the second end of the carrier sheet, such that the first pouch overlaps the second pouch.

19. The multi-dose cleaning product of claim 11, the first cleaning composition being at least one of a dishwashing detergent, a laundry detergent, a water softener, or a rinse aid.

* * * * *